US005176072A

United States Patent [19]

Larson

[11] Patent Number: 5,176,072

[45] Date of Patent: Jan. 5, 1993

[54] HAND HELD ALUMINUM CAN CRUSHER

[76] Inventor: David P. Larson, 844 E. Ramona Ave., Salt Lake City, Utah 84105

[21] Appl. No.: 792,695

[22] Filed: Nov. 15, 1991

[51] Int. Cl.[5] ..... B30B 9/00; B30B 1/00; B30B 9/32

[52] U.S. Cl. ..... 100/90; 100/226; 100/265; 100/295; 100/902

[58] Field of Search ..... 100/90, 98 R, 226, 265, 100/295, 902, 910; 68/215-218; 366/129, 342, 343

[56] References Cited

U.S. PATENT DOCUMENTS

| | | | |
|---|---|---|---|
| 130,523 | 8/1872 | Morris | 68/215 |
| 563,431 | 7/1896 | Strang | 366/129 |
| 680,555 | 8/1901 | Westervelt | 68/215 |
| 935,949 | 10/1909 | Van Langingham | 68/215 |
| 957,298 | 5/1910 | Baker et al. | 68/218 |
| 1,107,707 | 8/1914 | Ruppelt | 68/218 |
| 1,766,171 | 6/1930 | Hetherington | 100/295 X |
| 1,998,263 | 4/1935 | Townsend | 100/902 X |
| 2,025,654 | 12/1935 | Eberhard | 68/217 |
| 2,879,044 | 3/1959 | Gunas | 366/343 X |
| 4,133,261 | 1/1979 | Belfils | 100/902 X |
| 4,682,539 | 7/1987 | Bramblett et al. | 100/295 X |
| 5,033,375 | 7/1991 | Reeves | 100/902 X |

*Primary Examiner*—Harvey C. Hornsby
*Assistant Examiner*—Stephen F. Gerrity
*Attorney, Agent, or Firm*—Terry M. Crellin

[57] ABSTRACT

A hand held and hand operated device for compacting and crushing an aluminum beverage can is disclosed. The device comprises an elongate handle that is grasped by the user's hand. An aluminum can is held in a gripper element at one end of the handle. The free end of the aluminum can extending from the gripper element is then pounded against a solid object in a manner similar to pounding one's clenched fist against a table top thereby crushing and compacting the aluminum can.

4 Claims, 1 Drawing Sheet

HAND HELD ALUMINUM CAN CRUSHER

BACKGROUND OF THE INVENTION

1. Field of the Invention

The present invention relates to devices for use in compacting used aluminum beverage cans. In particular, the present invention relates to an inexpensive, simple device that can be used by a homemaker or one collecting aluminum cans to compact the aluminum cans for storage prior to delivering the crushed cans to a recycling facility.

2. State of the Art

Aluminum cans are used extensively for beverage containers. It has become ecologically desirable to recycle the empty aluminum cans after they have been used. However, storage of the empty cans becomes a problem. The cans are rather bulky, and it is advantageous to crush the cans to reduce their bulk during storage prior to delivery of the cans to a recycling facility. Unfortunately, there has been no inexpensive, simple device that has been proposed heretofore for allowing the homemaker or can collector to crush the used aluminum cans.

There have been proposed rather complex mechanical devices employing levers and other combinations of mechanical elements for crushing aluminum containers. These prior art devices are bulky and overly expensive. In the opinion of the applicant, U.S. Pat. Nos. 4,133,261; 4,197,796; 4,208,906; 4,228,734 and 4,682,539 represent the most relevant prior art of which the applicant is aware.

3. Objectives

A particular objective of the invention is to provide a novel, inexpensive device of very simple construction that can itself be readily stored by the homemaker with other household utensils and which can be used to easily and quickly crush aluminum cans at the time the cans are used by the homemaker.

Another objective of the present invention is to provide a simple, unitary device that is easily carried and stored by a person who might be collecting cans, whereby the device is useful to readily and quickly crush cans as the cans are collected.

It is still another objective of the present invention is to provide a simple, inexpensive device which can be used by one hand of the user and which will readily crush the aluminum can and thereby reduce the bulk of the cans that are being collected and stored.

BRIEF DESCRIPTION OF THE INVENTION

The above objectives are achieved in accordance with the present invention by providing a novel, hand held and hand operated device for compacting an aluminum beverage can. The device has an elongate handle element that is grasped by the hand of user of the device. An essentially flat plate is attached to one end of the elongate handle element so that one flat side of the flat plate is located adjacent to one of the ends of the elongate handle element, with the other flat side of the flat plate facing away from the end of the handle such that the flat plate is essentially perpendicular to a longitudinal axis of the elongate handle element.

Gripper means are provided on the side of the flat plate facing away from the elongate handle for gripping one end of an aluminum can, so that the one end of the aluminum can is retained adjacent to the side of the flat plate facing away from the elongate handle. The other end of the aluminum can then extends from the flat plate so that the longitudinal axis of the aluminum can is substantially perpendicular to the side of the flat plate that faces away from the elongate handle.

The device is used by attaching an aluminum can to the gripper means. The elongate handle element is then grasped in one of the user's hands, and the user pounds the free end of the aluminum can that extends from the device against a solid object to compact the aluminum can in the manner of pounding a table top with one's clenched fist.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENT

Figure 4:
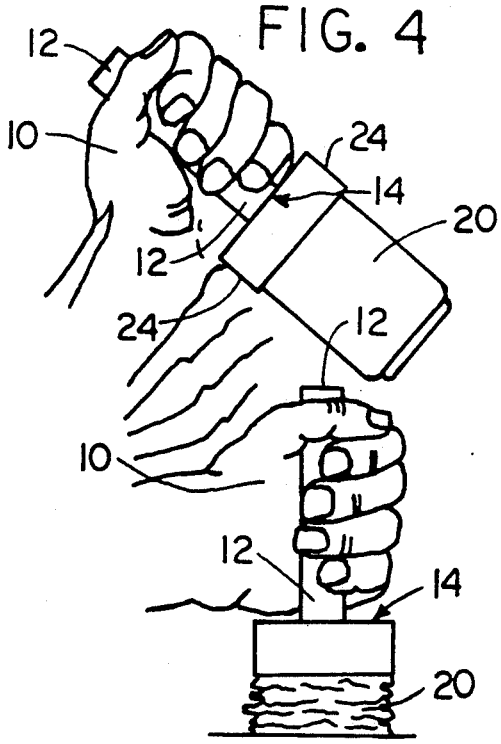
FIG. 4 is a side elevation showing how the can crusher is used.

Referring now to the drawings, there is shown a preferred embodiment of a hand held and operated device in accordance with the present invention for crushing and compacting an aluminum beverage can. The device comprises an elongate handle element 12 that is adapted to be grasped by the hand 10 (FIG. 4) of a user of the device. As illustrated, the elongate handle 12 can be a simple cylindrical rod or post that is to be grasped in one's hand as shown in FIG. 4. The handle element 12 and the other parts of the device which will be described below can be made of plastic, wood or metal. The handle element 12 itself can be either solid or hollow.

An essentially flat plate 14 having first and second essentially flat sides 16 and 18 is attached to the elongate handle element 12 at one end of the handle element 12. The first flat side 16 of the flat plate 14 is located adjacent to one end of the elongate handle element 12 and firmly attached to the handle element 12. The second flat side 18 of the flat plate 14 faces away from the one end of the handle element 12. The flat sides 16 and 18 of the flat plate 14 are substantially parallel with each other and essentially perpendicular to a longitudinal axis of the elongate handle element 12.

Gripper means are provided extending from the second side 18 of the flat plate 14 for gripping one end of an aluminum can 20 (FIG. 4) so that one end of the can is retained in the gripper means adjacent to the second side 18 of the flat plate 14. The other end of the aluminum can 20 extends from the flat plate 14 so that the longitudinal axis of the aluminum can 20 is substantially perpendicular to the second side 18 of the flat plate 14. Preferably, the gripper means is adapted to retain a single aluminum can 20 with the center of the flat plate 14 and the longitudinal axis of the can being in alignment with or coinciding with the longitudinal axis of the handle element 12.

In using the device as illustrated in FIG. 4, an aluminum can 20 is attached to the gripper means on the device, and the handle element 12 is grasped by the user's hand. The free end of the aluminum can 20 is then pounded against a solid object in a manner similar to pounding one's clenched first against a table top. The aluminum can 20 is crushed and compacted as it is pounded into the solid object.

Figure 1:
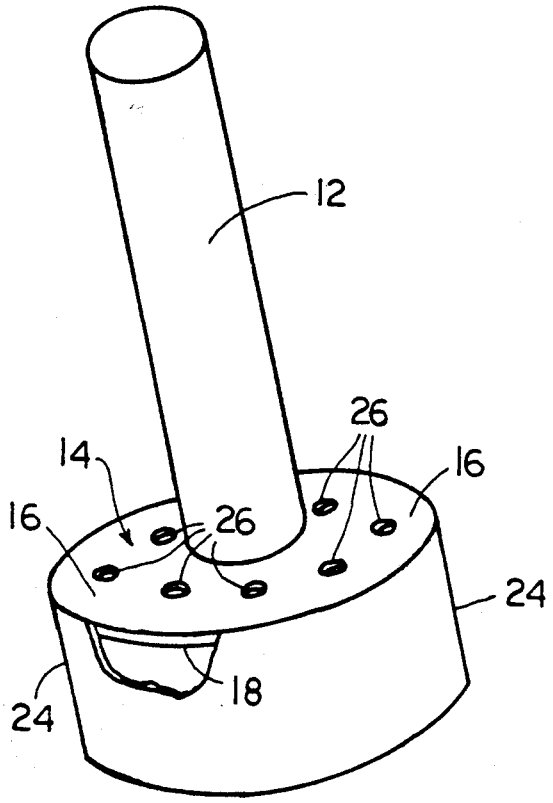
FIG. 1 is a pictorial representation of a preferred embodiment of the can crusher of the present invention.
Figure 2:
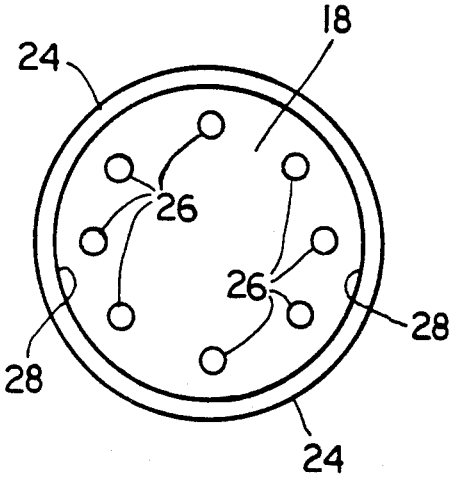
FIG. 2 is a bottom plan view of the can crusher of FIG. 1.

In the preferred embodiment of the device for crushing and compacting an aluminum beverage can as illustrated, the flat plate 14 has a circumferential perimeter, and the gripper means comprises a shallow, hollow, cylindrical element 24 extending from the perimeter of the flat plate 14 away from the second side 18 of the flat plate 14. In one embodiment, the cylindrical element 24 has an internal surface 26 (FIG. 2) that has a diameter such that one end of the aluminum can is received snugly within the shallow, hollow, cylindrical element 24. The aluminum can is then held within the cylindrical element 24 by frictional engagement between the inner surface of the cylindrical element 24 and the outer surface of the aluminum can.

Figure 3:
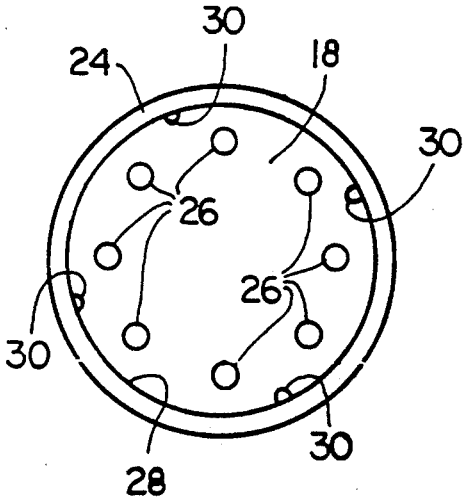
FIG. 3 is a bottom plan view similar to that of FIG. 2, but showing a slight modification in the inner side wall of the gripper element of the device.

In a modified embodiment of the device as illustrated in FIG. 3, the cylindrical element 24 forming the gripper means further includes at least about 3 friction elements 30 located on the internal surface 26 of the cylindrical element 24. The frictional elements 30 make frictional engagement with one end of the aluminum can that is received in the cylindrical element 24 so as to retain the end of the aluminum can within the cylindrical element 24. As illustrated, in FIG. 3, there are four, equally spaced frictional elements 30 formed by longitudinal protrubences or ridges formed on the inner surface of the cylindrical element 24.

Advantageously, there are a plurality of openings 26 provided in the flat plate 14 that allow gas to move from the aluminum can on one side of the flat plate through the openings 26 as the aluminum can is being crushed and compacted. When openings 26 are provided in the flat plate 14, it is advantageous to attach the aluminum can to the gripper means such that the opened end of the can enters the cylindrical element 24. During crushing of the aluminum can 20 as shown in FIG. 4, air inside the can is expelled through the open end of the can, and the expelled air is exhausted through the openings 26 in the flat plate 14 of the gripper means.

Although preferred embodiments of the novel device for crushing aluminum beverage cans of the present invention has been illustrated and described, it is to be understood that the present disclosure is made by way of example and that various other embodiments are possible without departing from the subject matter coming within the scope of the following claims, which subject matter is regarded as the invention.

I claim:

1. A hand held and operated device for compacting an aluminum beverage can comprising:

an elongate handle element for being grasped by the hand of a user of the device;

an essentially flat plate having a circumferential perimeter and first and second essentially flat sides, said flat plate being attached to said elongate handle element so that the first flat side of said flat plate is located adjacent to one of the ends of said elongate handle element, with the flat sides of said flat plate being essentially perpendicular to a longitudinal axis of said elongate handle element; and gripper means on the second side of said flat plate for gripping one end of said aluminum can so that said one end is retained adjacent to the second side of said flat plate and the other end of said aluminum can extends from said flat plate so that the longitudinal axis of said aluminum can is substantially perpendicular to said second side of said flat plate, said gripper means comprising a shallow, hollow, cylindrical element extending from the perimeter of said flat plate away from the second side of said flat plate, with said cylindrical element having an internal surface that has a diameter such that said one end of said aluminum can is freely received within the shallow, hollow, cylindrical element, said cylindrical element further including friction elements located on the internal surface of said cylindrical element, with said frictional elements making frictional engagement with the one end of the aluminum can so as to retain the one end of the aluminum can within said cylindrical element, whereby the device is used by attaching said aluminum can to said gripper means, grasping the elongate handle element and pounding the free end of the aluminum can that extends from the device against a solid object to compact the aluminum can.

2. A device for compacting an aluminum beverage can in accordance with claim 1 wherein at least one opening is provided through said flat plate that allows gas to move from one side of said flat plate through said opening to the other side of said flat plate.

3. A device for compacting an aluminum beverage can in accordance with claim 2 wherein there are a plurality of openings provided in said flat plate that allows gas to move from one side of said flat plate through the openings to the other side of said flat plate.

4. A device for compacting an aluminum beverage can in accordance with claim 1 wherein the center of said flat plate and the cylindrical axis of said cylindrical element are in alignment with the longitudinal axis of said handle element.

* * * * *